US005319937A

United States Patent [19]

Fritsch et al.

[11] Patent Number: 5,319,937

[45] Date of Patent: Jun. 14, 1994

[54] THERMOELECTRIC COOLER AND WARMER

[75] Inventors: Udo Fritsch, Milford, N.H.; James J. J. Costello, Houston, Tex.

[73] Assignee: Igloo Products Corporation, Houston, Tex.

[21] Appl. No.: 52,290

[22] Filed: Apr. 26, 1993

Related U.S. Application Data

[63] Continuation of Ser. No. 774,352, Oct. 10, 1991, abandoned.

[51] Int. Cl.[5] ..... F25B 21/02

[52] U.S. Cl. ..... 62/3.62; 62/457.7; 62/457.9; 62/455; 62/426; 292/DIG. 38

[58] Field of Search ..... 62/3.2, 3.3, 3.6, 3.61, 62/3.62, 457.9, 457.7, 455, 404, 426; 292/253, DIG. 38

[56] References Cited

U.S. PATENT DOCUMENTS

| | | | |
|---|---|---|---|
| 2,715,817 | 8/1955 | Brodheim | 62/457.9 |
| 2,943,452 | 7/1960 | Buchanan | 62/3.3 |
| 3,069,869 | 12/1962 | Mueller | 62/457.9 |
| 3,111,166 | 11/1963 | Munz et al. | 62/3.3 |
| 3,232,063 | 2/1966 | Eichhorn et al. | 62/3.6 |
| 3,822,905 | 7/1974 | Bell | 292/87 |
| 4,095,711 | 6/1978 | Conley | 220/94 R |
| 4,344,646 | 8/1982 | Michel | 292/87 |
| 4,379,391 | 4/1983 | Rhee | 62/408 |
| 4,726,193 | 2/1988 | Burke et al. | 62/3.3 |
| 4,823,554 | 4/1989 | Trachtenberg et al. | 62/3.3 |

*Primary Examiner*—Henry A. Bennet
*Assistant Examiner*—William C. Doerrler
*Attorney, Agent, or Firm*—Cushman, Darby & Cushman

[57] ABSTRACT

A thermoelectric cooler and warmer which has a unique ventilation system to distribute cool or warm air throughout the unit so that there are no hot or cool spots, a door which is mounted so that it can be easily opened whether the door is facing up or facing front, a lid or door latch which can be easily and reliably operated, and/or a handle configuration which does not unbalance the unit so that it can be advantageously placed with the door up or on an end with the lid or door facing front so that it can be advantageously used as a conventional chest or as a portable mini-refrigerator or warming unit.

30 Claims, 9 Drawing Sheets

THERMOELECTRIC COOLER AND WARMER

This is a continuation of application Ser. No. 07/774,352, filed on Oct. 10, 1991, which was abandoned upon the filing hereof.

BACKGROUND OF THE INVENTION

1. Field of the Invention

The present invention relates to a container, particularly for food and beverages, which can be selectively used as cooler or a warmer. More particularly, the present invention relates to a portable container which can be oriented with its lid or door facing up as a top opening ice chest or which can be stood up on an end as a mini-refrigerator or mini-warming oven with a front opening door and which, in order to accommodate such various orientations and alternate heating or cooling utilities, includes a particularly unique air ducting system, door disposition, lifting handles and/or door closing latch.

2. Description of the Art

Coolers are typically in the form of an insulated container which has walls upstanding from a base to define a top opening to which a removable cover is mounted. Thus, such coolers are typically rectangular with two sidewalls and two end walls, and have a pivotal handle assembly mounted to each end wall for carrying the cooler. As such, conventional coolers are intended to be disposed solely on the bottom or back wall and the lid, whether or not hinged along one edge, is simply interlocked with the container by a friction fit and/or by engagement with pivotally mounted locking carrying handles which selective engage and hold the lid on the container.

Typically coolers of the type described above are used as ice chests. Thus, when the food and/or beverages are to be kept cool, they are placed in the container and ice is added to the container to maintain the food cool. Such ice chests have a number of disadvantages. For example, as the ice melts, water will be present in the base of the container and must be periodically removed. Often, outlet ports are provided in such coolers to allow the melted ice to be drained. Still, for the most part, only hermetically sealed containers can be placed within the container if water damage is to be avoided. Further, to keep the contents cool for an extended period, ice must be repeatedly added.

Furthermore, because ice is required to maintain the food and beverages cool, only a relatively small amount of food can actually be stored within a cooler of a given size and the weight of the cooler is significantly increased by the presence of the ice.

It has recently been proposed to incorporate within a cooler type container a cooling system so that when the container is coupled to a power source, food and beverages within the cooler will be automatically cooled. With such automatic cooling, there is no need for ice and thus the container can hold more food and beverages than conventional ice chests of comparable size. The thermoelectric technology which allows a cooling system to be incorporated in a cooler was developed by NASA and eliminates the need for bulky compressors and piping. Furthermore, as an alternative to cooling, such newly developed systems can be used to warm foods by reversing the insertion of the plug to the system. Because such alternative cooling/heating systems are known a detailed disclosure of the heating/cooling system is omitted herein.

With the advent of positive cooling or warming within a portable container, there has been a desire to provide portable food containers which can be used both in a conventional ice chest orientation with the lid or door on top and in an end up orientation as a "college dorm room", hotel, or office refrigerator/warming oven with a front opening door.

The original portable thermoelectric coolers were introduced in the 1980's. One such unit (application Ser. No. 07/387,891, filed Jul. 31, 1989) included a sink and very small fan that would agitate the air across the aluminum fins of the sink to distribute the air more rapidly than convection alone. By reversing the polarity by reversing the plug on 12 V DC the heat pump would reverse itself, as noted above. That prior heater/-cooler had a positive latch which latched the lid to the main body of the container by rotating an element mounted to the main body to engage a protruding element on the lid. The handles provided on that container were U-shaped and were pivotally mounted at the ends of the legs of the U so as to hang freely at either end of the container. A support base was provided for that system so that it could be mounted up on its end without interfering with opening and closing of the lid or door and so that the exteriorly mounted handle would not unbalance the container when so oriented. While the above-described unit has advantages, that is not to say the improvement thereof is not possible.

SUMMARY OF THE INVENTION

It is an object of the invention to provide a thermoelectric cooler and warmer which has a unique ventilation system to distribute cool or warm air throughout the unit so that there are no hot or cool spots, a door which is mounted so as allow easy opening and closing irrespective of unit orientation, a lid or door latch which can be easily and reliably operated, and/or a handle configuration which allows the unit to be advantageously placed with the lid or door up or on an end with the lid or door facing front so that it can be advantageously used as a conventional chest or as a portable mini-refrigerator or warming unit. Thus, the assembly of the invention is designed to provide a unique combination of components which allow the unit to be selectively placed up on an end as a refrigerator.

As noted above, one of the objects of the invention is to provide handles on a portable container which do not interfere with an end up orientation of the unit so that the unit can be utilized as a portable end standing refrigerator. Thus, the handles of the invention are recessed, are preferably slidably mounted in the end walls of the unit adjacent its edge, and are preferably pivotable relative to the end wall when fully withdrawn.

The latch utilized to couple the door or lid of the container to the main body has been designed for ease of operation and quick opening while still ensuring that the lid or door is firmly engaged on closing. To accomplish the foregoing object, a living spring or hinge is incorporated within the latch structure and a catch is formed on the main body, preferably within a recess. Thus, the latching end of the latch structure can be flexed relative to the door to selectively engage the catch on the main body to retain the door in its closed orientation. A cover plate can be permanently or removably mounted over a portion of the latch structure for aesthetic purposes and to ensure that the latch is not accidentally disengaged.

In accordance with yet a further feature of the invention, an air flow duct system is provided which picks up and recirculates the cooling or heating air. The fan of the system advantageously pulls air from the back or base of the container, depending upon its orientation, and directs it down through a duct in the door so that the cool or warm air is continuously circulated throughout the interior of the unit. In this manner, a uniform heating or cooling of food products or beverages within the unit is possible.

Other objects, features, and characteristics of the present invention as well as the methods of operation and functions of the related elements of structure, and the combination of parts and economies of manufacture, will become more apparent upon consideration of the following description and the appended claims with reference to the accompanying drawings, all of which form a part of this specification, wherein like reference numerals designate corresponding parts in the various Figures.

DETAILED DESCRIPTION OF THE PRESENTLY PREFERRED EXEMPLARY EMBODIMENTS

Figure 1:
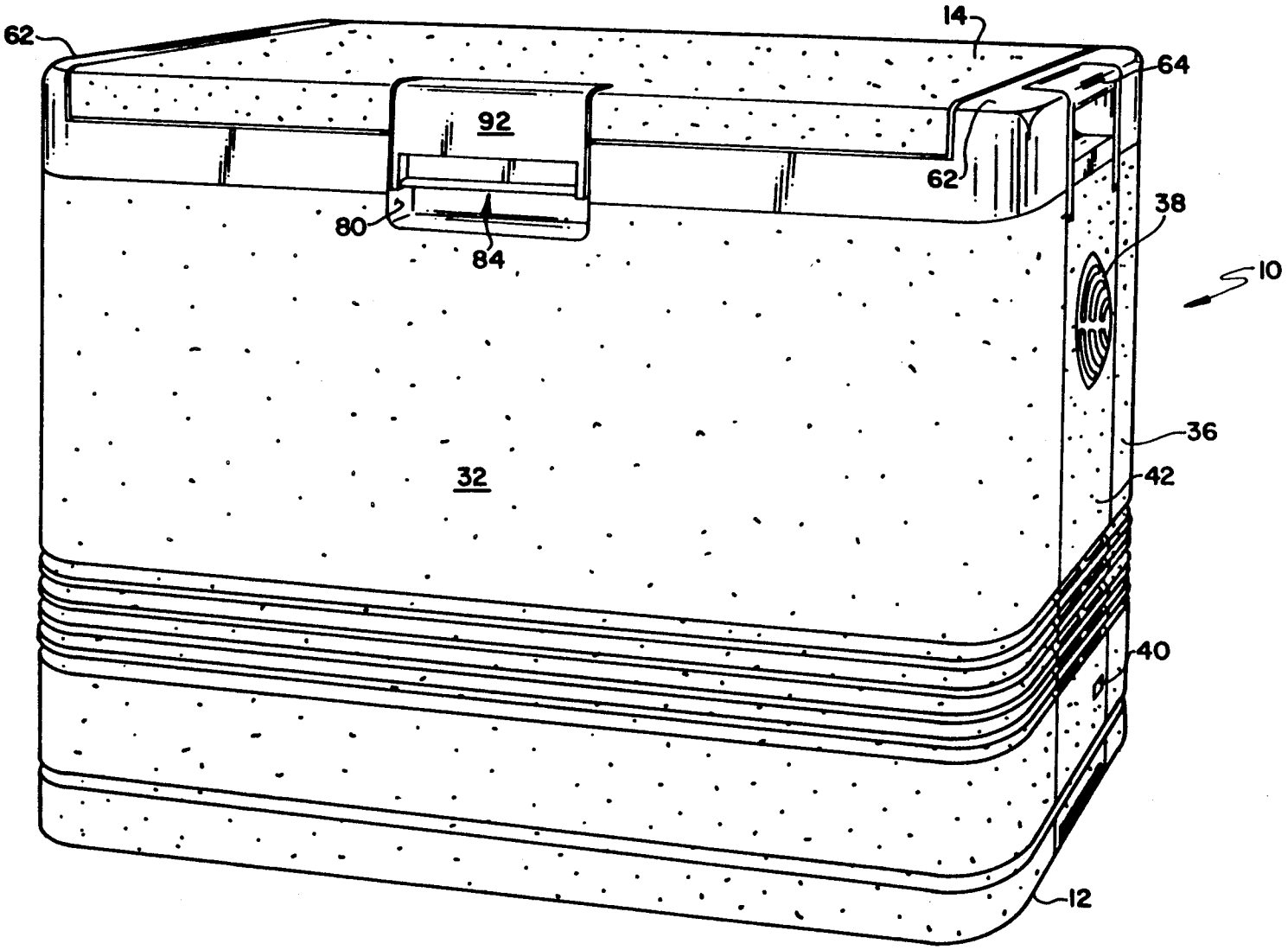
FIG. 1 is a perspective view of a thermoelectric cooler and warmer in accordance with the present invention.
Figure 2:
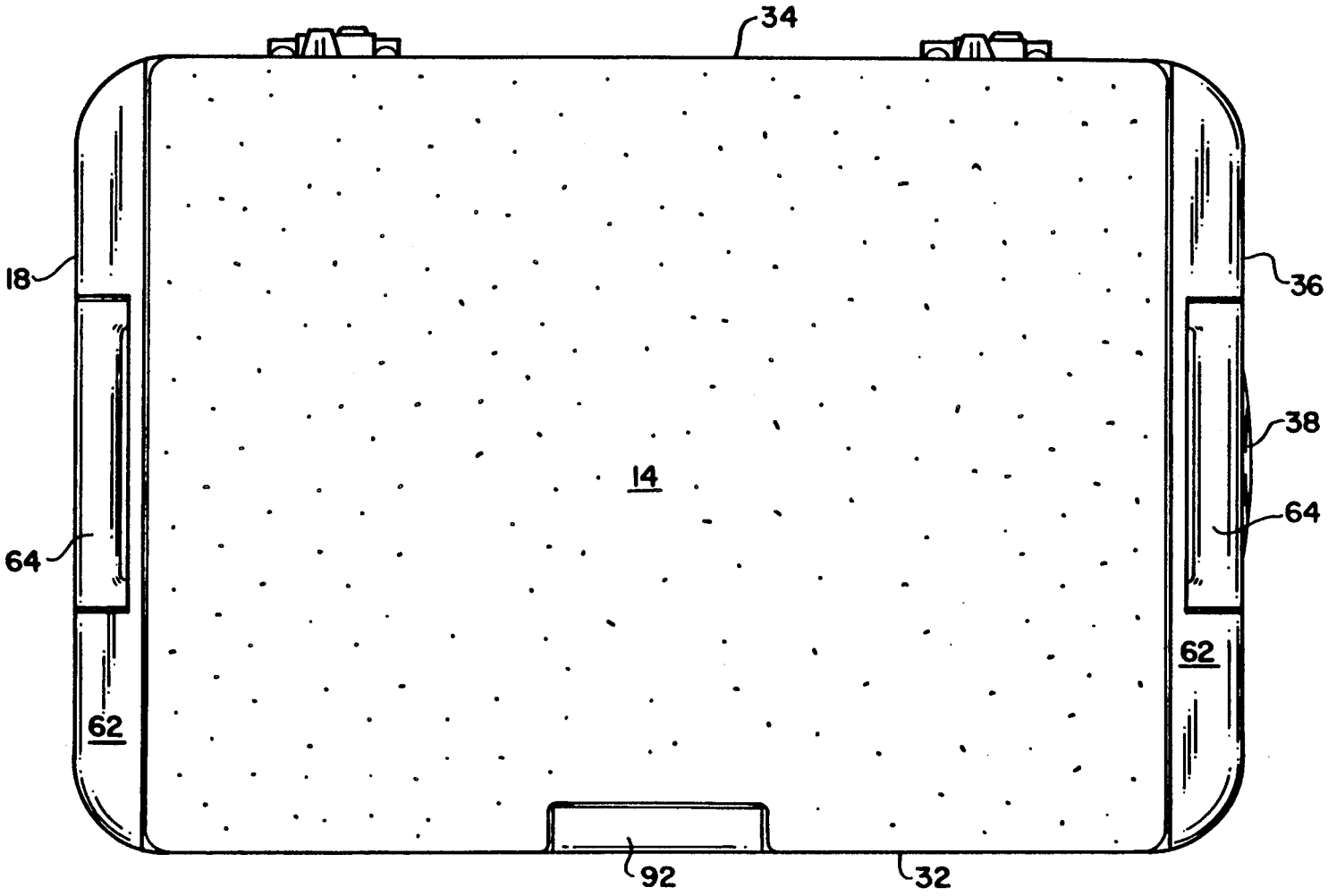
FIG. 2 is a top plan view of the cooler and warmer of the invention.
Figure 7:
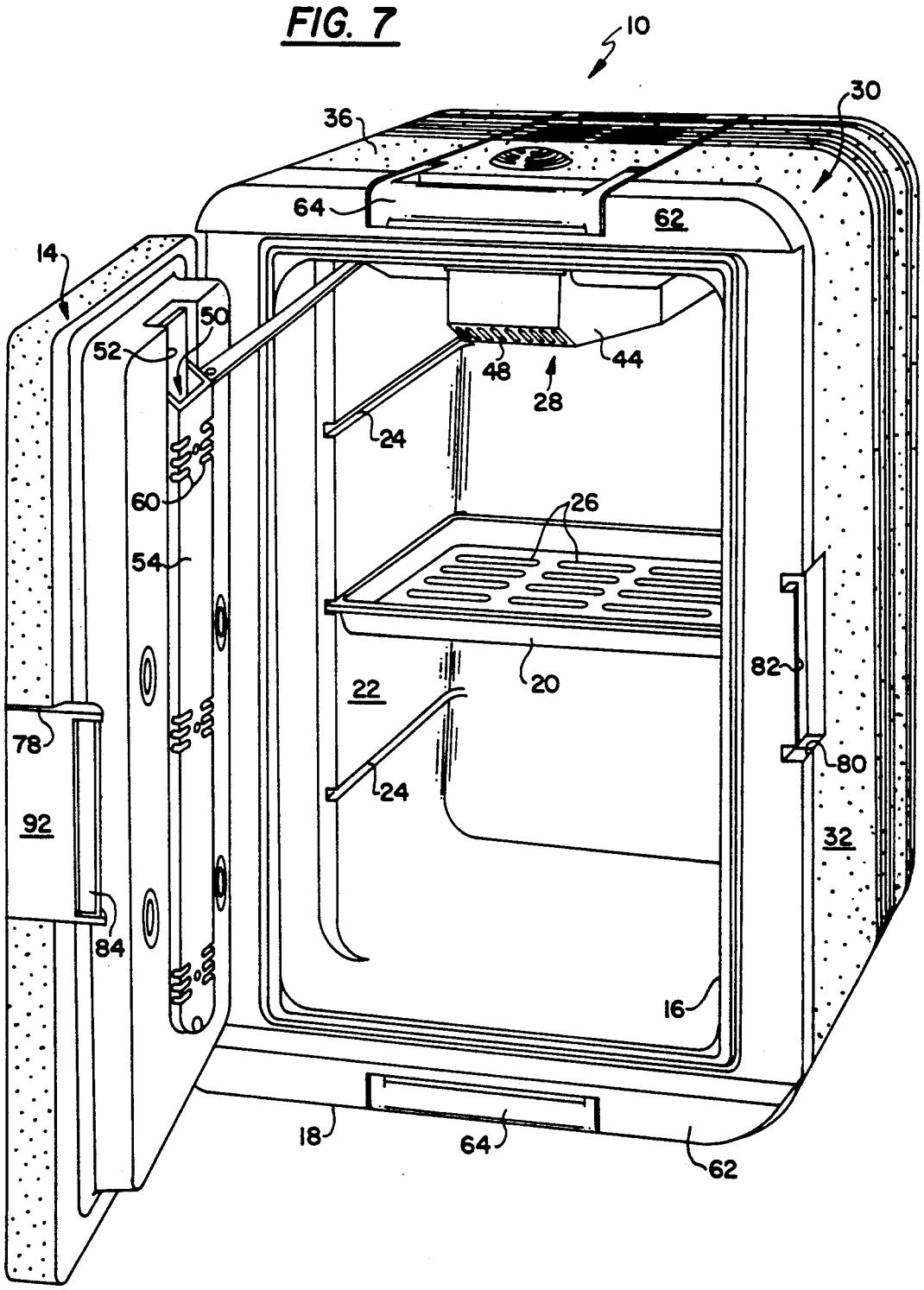
FIG. 7 is a perspective view showing the assembly of the invention in its end up orientation.

A cooler/heater 10 provided in accordance with the present invention is shown in particular in FIGS. 1 and 7. As illustrated in FIG. 1, the unit can be disposed on the back side or base 12 so that the lid or door 14 opens upwardly to reveal a compartment 16 for receiving food and beverages to be heated or cooled. In the alternative, the unit 10 can be turned on its end 18 as a mini or dorm-type refrigerator or warming oven as shown in FIG. 7. To best function as a refrigerator, one or more shelves 20 are removably mounted within the unit 10. Thus, in the illustrated embodiment, the inner shell 22 of the unit is molded with one or more pairs of slots 24 into which shelves can be inserted. While the shelves may be of any desirable configuration, in the illustrated embodiment the shelves 20 are in the form of trays of nominal thickness which have one or more slots 26 for ventilation. When the unit is in its top-opening chest orientation as shown in FIG. 1, the shelves 20 may be removed or may be retained within the unit 10 to serve as partitions and/or to isolate the fan unit 28 from the contents of the unit to thus ensure that the fan unit 28 can properly draw air from the rear of the compartment 16 and recirculate and re-warm or re-cool that air, as described herein below.

Figure 3:
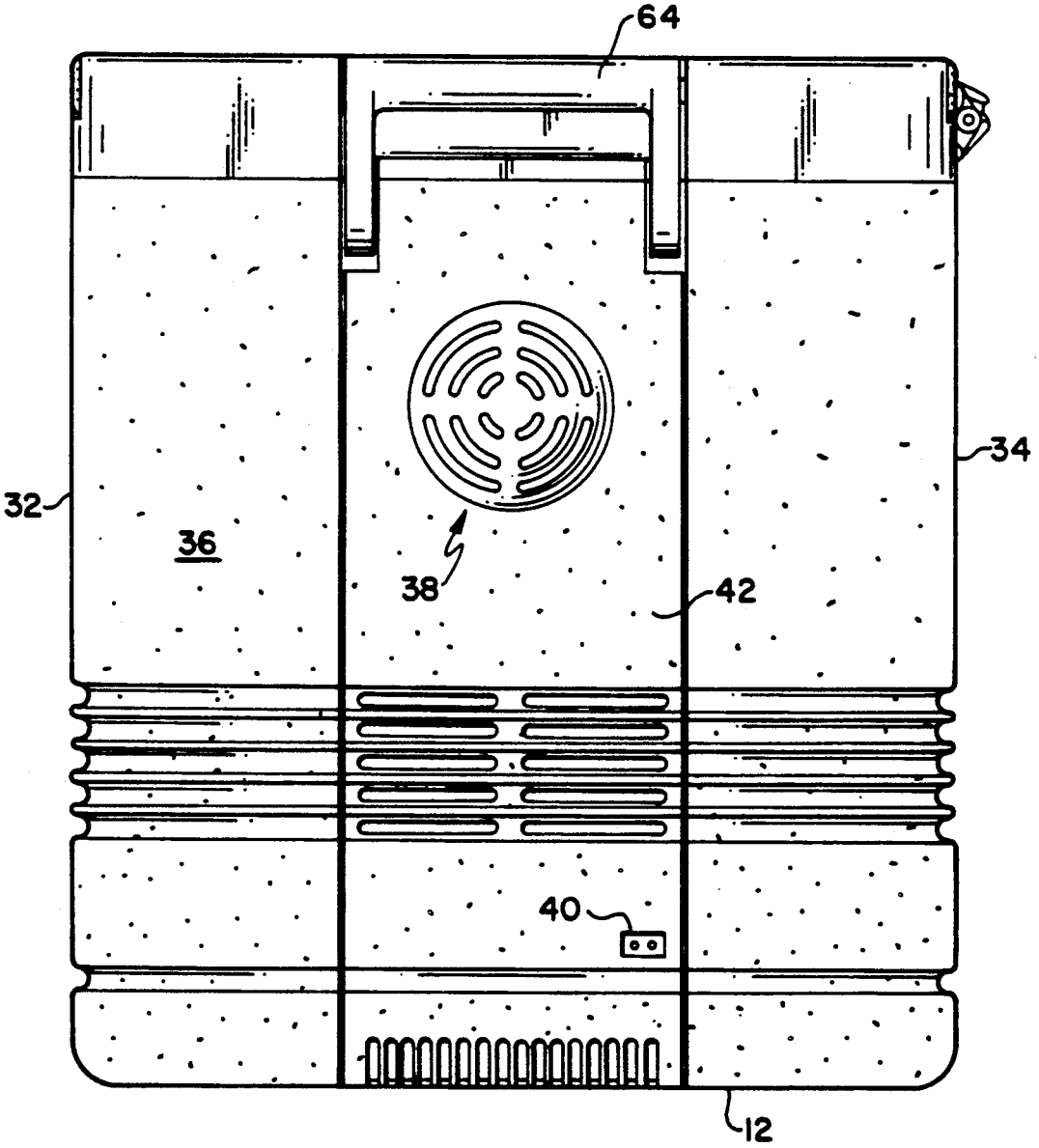
FIG. 3 is an elevational view of the end of the cooler and warmer of the invention which incorporates the thermoelectric components.
Figure 4:
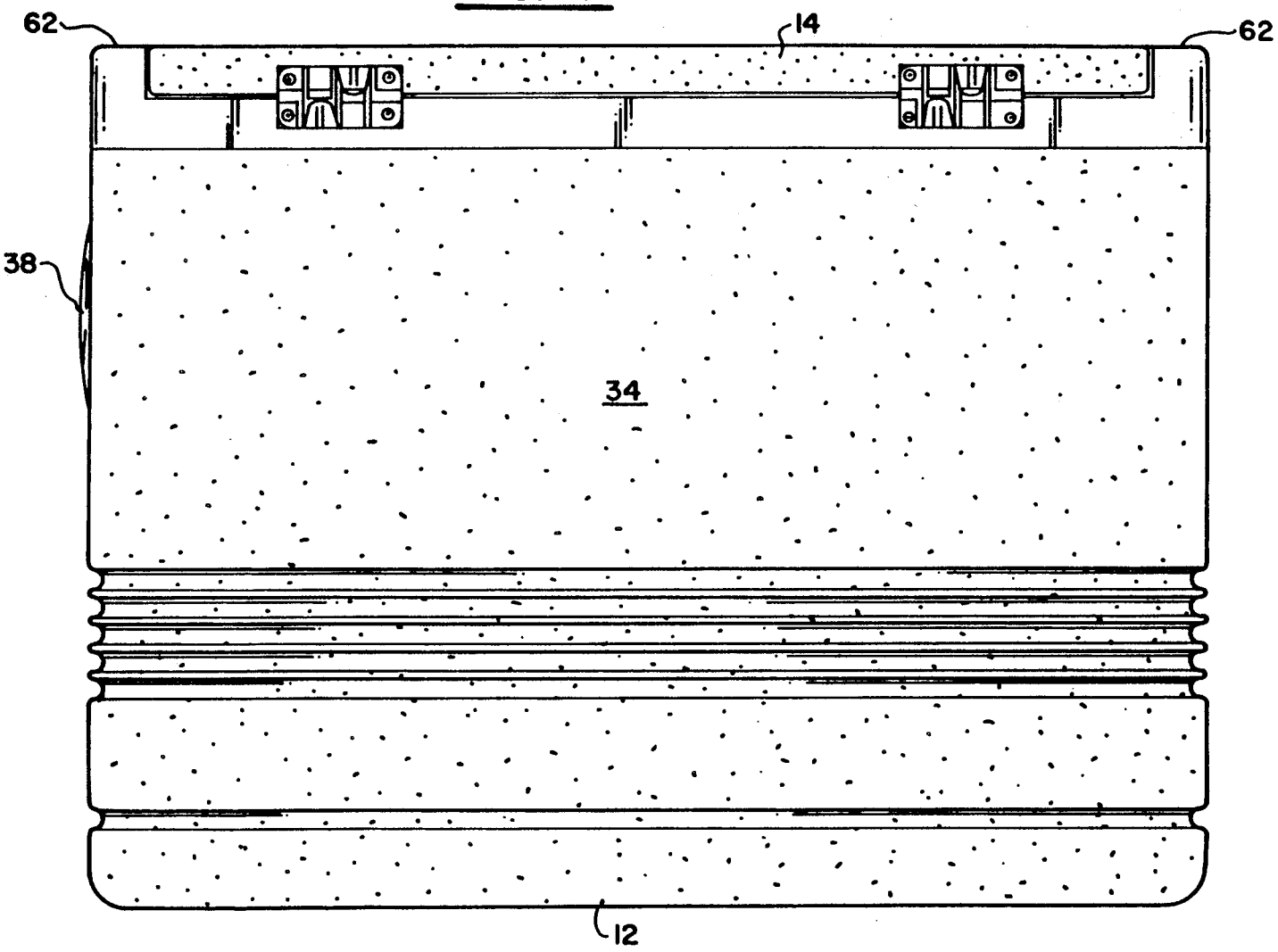
FIG. 4 is a rear elevational view of the unit of the invention.

As noted above, the main body 30 of the unit has a base or rear wall 12, depending upon the orientation of the unit, first and second side walls 32, 34 and first and second ends 18, 36. One end 36 of the unit (FIG. 3) which is adapted to be the top of the unit 10 when orientated as a mini-refrigerator (FIG. 7) includes the thermoelectric components which allow the unit to selective function as a cooler or a heater. The particular thermoelectric components are known and are therefore not described herein in detail. It should be noted, however, that the thermoelectric components include a fan and therefore a fan opening shown generally at 38 is provided in the end 36. Preferably, the fan opening is a dome of concentric circular openings as shown to prevent blockage of air flow if an item is placed on top of the unit when oriented as shown in FIG. 7, or abutted against end 36 when oriented as shown in FIG. 1. It has also been found that using a concentric circle-type grill is quieter than other vent configurations.

A receptor 40 for a plug of a power cord (not shown) is also provided in end 36. The power cord is adapted to be coupled to a 12 V power source (cigarette lighter) so that the system can be used in a car, boat, recreational vehicle, airplane or the like. An AC/DC converter (not shown) can further be provided to allow the unit of the invention to be placed in a home, hotel or a dorm room and plugged into a wall outlet. As with known cooler/-heater units, the unit cools the contents when the plug inserted into the receptacle 40 is oriented in one way and will heat the contents if the plug is flipped over and inserted in the receptacle 40. In the illustrated embodiment, a panel 42 is provided over the electronic components so as to allow access and repair if necessary.

On the interior of the unit, a fan (not shown in particular) and a sink (not shown in particular), for example, a plurality of aluminum fins, are provided. A turbine-type fan which is very quiet and very efficient is preferably used. Again, such components are known and are therefore not described in particular herein.

Figure 10:
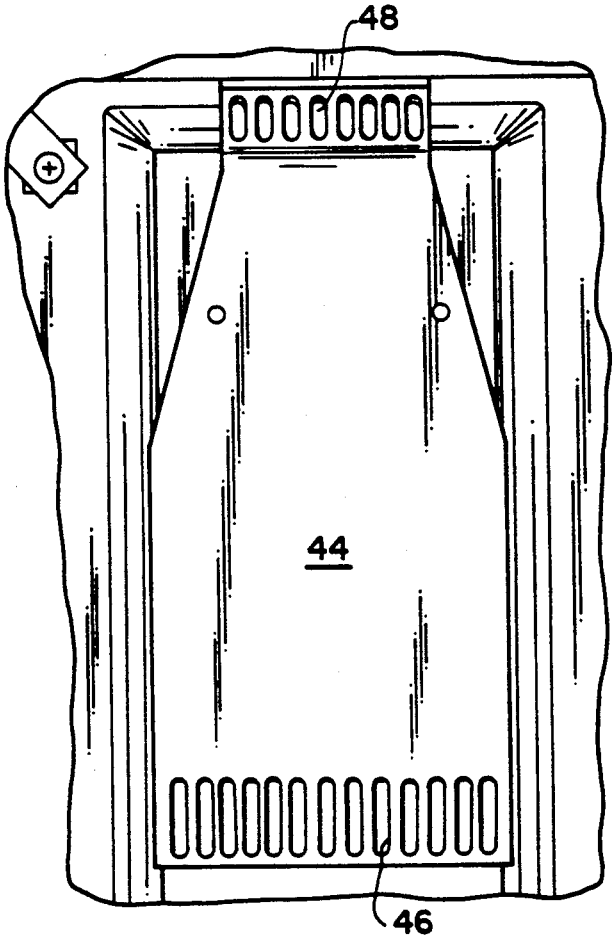
FIG. 10 is an interior end view showing the fan cover of the air recirculation system of the invention.

In accordance with the invention, the fan and sink are covered by a fan cover 44 as shown in FIG. 10 to define fan unit 28. The fan and sink cover 44 includes an opening at one end, for example, a series of vent openings 46, which defines an air intake adjacent the base or back 12 of the unit. Another opening, in the form of a plurality of apertures 48 is provided at the opposite end of the fan cover 44 and define an air outlet. The fan cover 44 is preferably removably attached to the inner side wall of the unit so that it can be removed for cleaning and/or to provide access to the fan and/or sink components. The fan is oriented and/or partially enclosed so that air will be drawn by the fan through vent openings 46, past the sink, and then thrown by the fan out through apertures 48.

Figure 8:
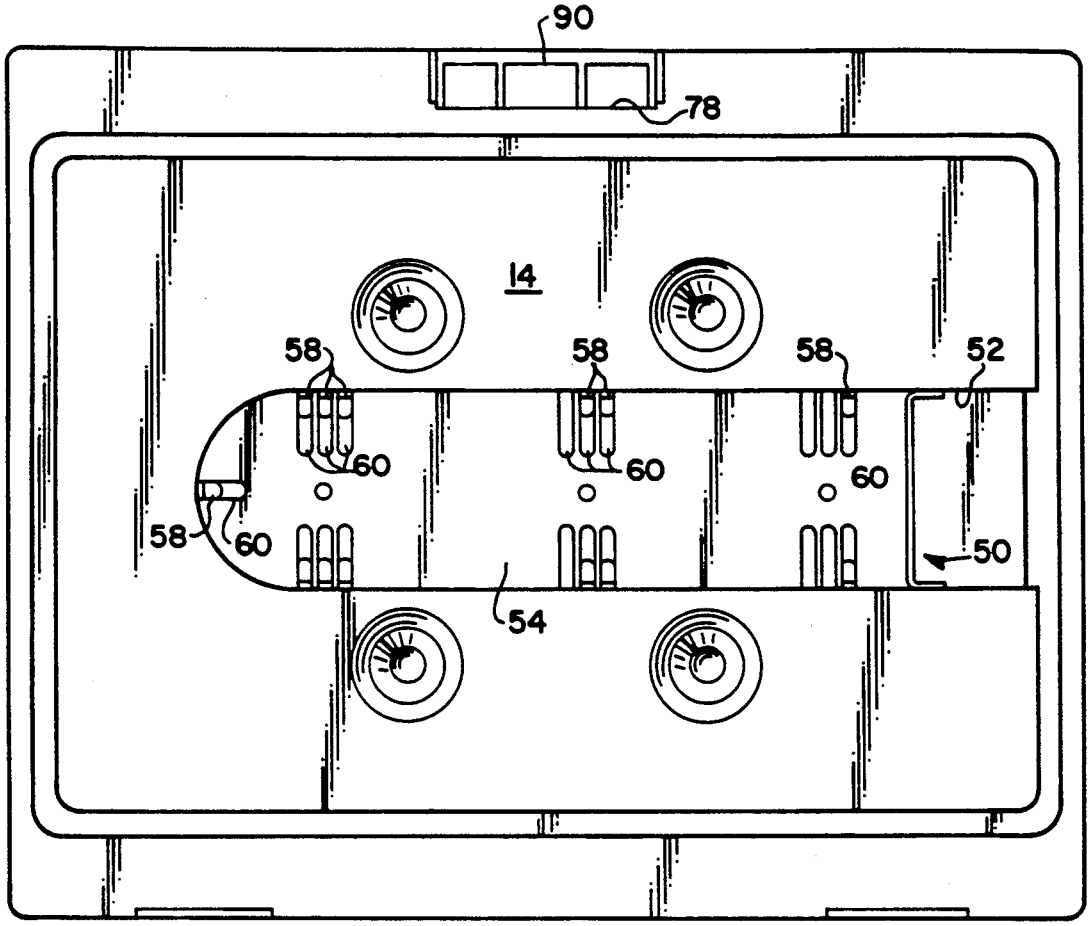
FIG. 8 is an elevational view of the interior surface of the lid or door of the unit of the invention.

As can be seen in particular in FIGS. 7 and 8, the air which exits the fan and sink cover 44 is directed through a recirculating air duct 50 defined in the lid or door 14 of the unit 10. In the illustrated embodiment, a channel 52 is formed along the length of the inner surface of the door 14 and a U-shaped cover element 54 is fixedly secured to define the air flow passage or duct 50. The cover may, for example, be bolted with bolts 56 to the inner surface of the door 14 so as to be positively retained in position.

Apertures are defined at spaced locations along the length of the duct to define recirculant air outlets. Because the pressure or force of the air decreases as it passes along the length of the duct 50, in order for the air to be uniformly distributed throughout the container, fewer and/or smaller air openings 58 are provided adjacent to the fan cover 44 and more and/or larger air openings 58 are provided remote from the fan cover 44. Thus, in the illustrated embodiment, although three pairs of dimples 60 are defined at three spaced locations along the length of the duct cover 54, as can be seen on careful examination, only a single pair of openings 58 are actually defined through the duct cover or wall 54 at the fan end of the duct 50, two pairs of openings 58 are provided at the mid point of the duct 50, and three pairs of openings 58 are provided at the lower most end of the duct 50. In the illustrated embodiment, furthermore, an end dimple 60 and opening 58 are provided so that air can exit at the end of duct 50. Note that the curved walls at the end of duct 50 facilitate flow out through the end opening. By providing three pairs of dimples 60, although fewer openings may be provided, as noted above, the unit is particularly aesthetically pleasing in that the dimple configuration is symmetric in spite of the varying number of openings. By providing a recirculating flow by virtue of the fan cover 44 and the air duct 50, the unit of the invention advantageously ensures that the entire contents of the unit will be uniformly heated or cooled.

In accordance with the invention, to provide a heating or cooling unit which can be advantageously presented on an end, a lip, edge or rim 62 is formed at each end of the upper or front surface of the unit so that the door 14 can be opened when the unit 10 is turned on its end. (FIG. 7) Furthermore, in order for the unit to be turned on its end, recessed handles 64 are provided so that the handles do not interfere with upstanding of the unit. At the same time, handles 64 can be easily gripped even in the event the unit 10 is abutted against a wall or other equipment. Even further, because a lip or rim 62 is advantageously provided and the handles 64 are exposed at the uppermost or frontmost face of the unit, in those rims, recession of the handles 64 does not interfere with the electrical components required for the heating-/cooling functions.

Figure 5:
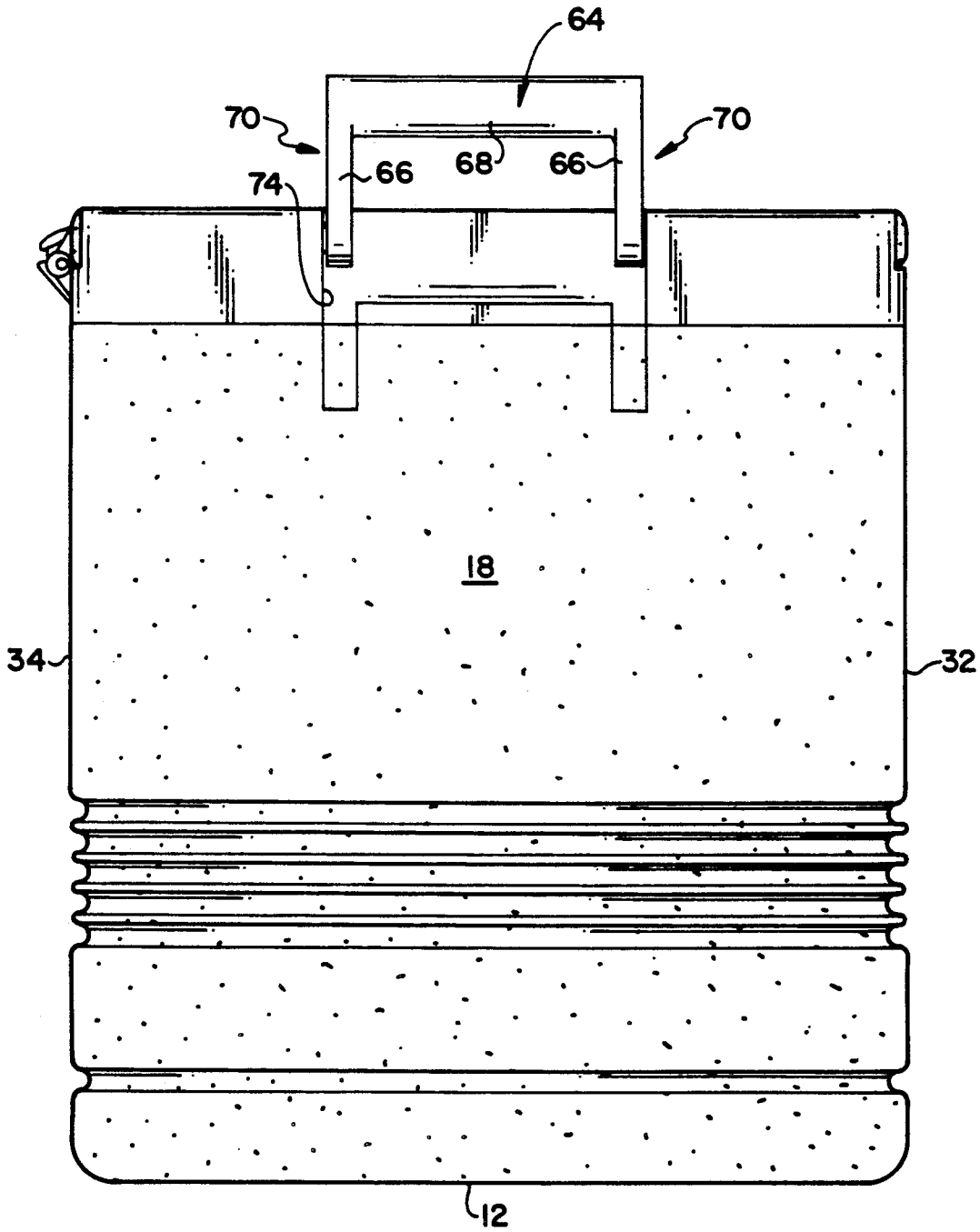
FIGS. 5A and 5B are views of the handle assembly provided in accordance with the present invention.
Figure 6:
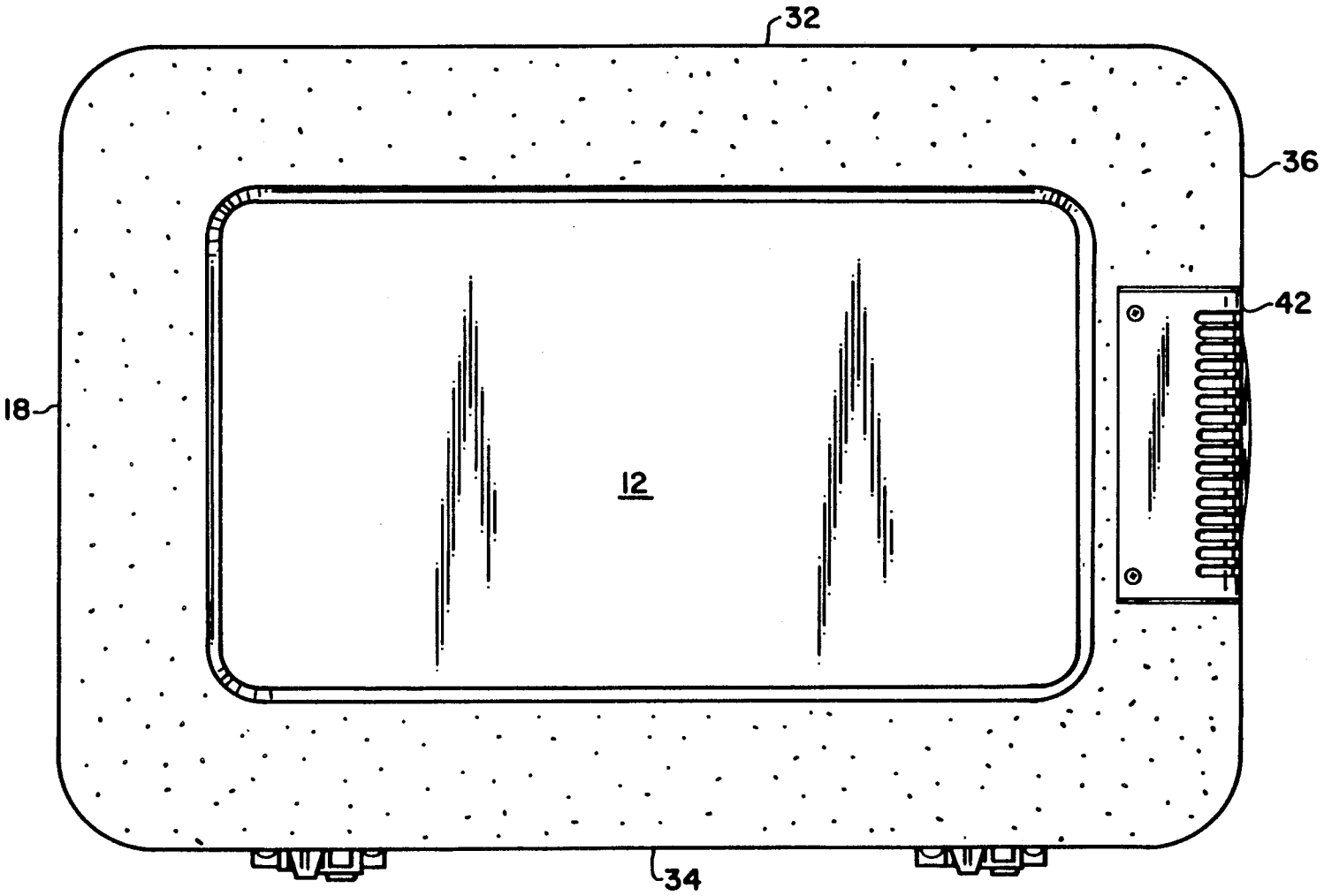
FIG. 6 is a bottom plan view of the unit of the invention.
Figure 5B:
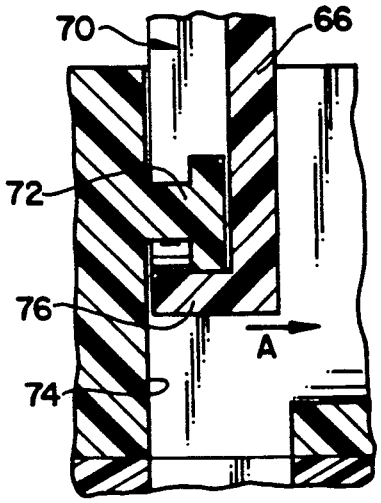

Thus, as shown in particular in FIGS. 5A and 5B, the handles are preferably U-shaped having first and second legs 66 and a transverse gripping portion 68. Each leg 66 is formed as a hollow channel 70, for example a U-shaped channel which receives a pin or peg 72 extending from the handle receiving pocket 74 of the end wall 18,36. The interengagement of the groove or channel 70 and protruding pins 72 allows the handle 64 to be slid in the plane of the end wall 18,36. At the maximum extent of withdrawing the handle from its recess, the pin 72 engages the end wall 76 of its respective leg 66 and thus the unit 10 can be lifted by one or both of those handles 64. Advantageously, furthermore, when the handle 64 has been withdrawn to its maximum extent, the handle 64 can be pivoted outwardly (of the plane of FIG. 5A) and downwardly about the respective pins 72, thus allowing the container to be easily pulled by one handle and/or the handle on end 36 of the unit can be pulled and pivoted to assist uprighting the unit to its mini-refrigerator orientation. As is apparent, where the handle is formed from sufficiently resilient plastic, by deflecting one or both legs of the U-shaped handle towards one another (arrow A in FIG. 5B) when the handle is fully withdrawn, the handle can be disengaged from the pins 72 and hence the unit for replacement or repair and/or for cleaning. While a particular disposition of pins and channels have been shown, it is to be understood that alternate arrangements could be provided, such as pins which extend into channels defined in the other side of the legs.

As a further alternative to the illustrated structure, the pin can have a narrow neck and enlarged head and each leg of the handle can be an essentially closed hollow element with an elongated slot to allow relative sliding of the handle and end wall. Where a slot is thus provided, the channel of each handle is preferably fully open at its distal most end so that, as noted above, the handles can be removed and/or replaced.

Thus, in accordance with the invention, to allow the portable container to be selectively used as a dorm-style refrigerator, the handles are advantageously recessed in the end walls of the unit and are accessible from adjacent each end of the door. One of the problems with a portable positive cooling and/or heating unit is that recessing the handles in the end walls of the unit may significantly limit or displace the space in which the electrical components for heating/cooling the system could be provided. Thus, an end mounted handle can not simply be recessed at the point where the handle was ordinarily mounted to the side wall without greatly decreasing the capacity of the unit. With the system of the invention, the capacity of the unit is not compromised because the necessary and desirable amount of space for the electrical components is provided in the end wall in spite of the recession of the handle. Indeed, because the handle is mounted at the corner of the unit, it does not interfere with the components for heating-/cooling which are placed within one end, preferably that which is ultimately the top end, of the unit.

Further, the recessed handle of the invention is accessible from the upper surface. Thus, even if the cooler/-heater is tightly packed, for example, in the back seat, trunk or cargo area of a vehicle, the handles can be easily grasped from above and used to lift the unit.

Even further, by providing end rims between which the lid or door of the container is disposed, the unit provides its own base so that the door can be easily opened and closed when standing on its end. Thus, providing the end edges or rims as shown defines a base for the unit when in its upright position which allows the door to open and also provides a locus for mounting the recessed handle so that it is easily accessible and does not interfere with the door or the end installed electrical components.

Figure 9:
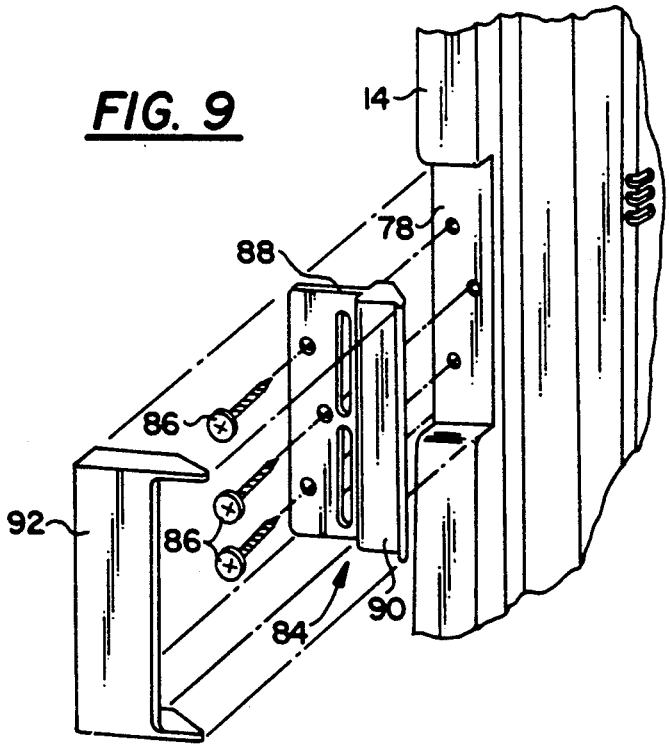
FIG. 9 is an exploded perspective view illustrating the details of the latch assembly of the invention.

The invention further provides a positive latch for the lid or door 14 of the unit 10 which facilitates its use as either a portable heating or cooling unit with a top lid or as a dorm type mini-refrigerator with a front opening door. Specifically, a latching mechanism is provided which requires no rotating or pivoting latch elements which could become jammed or which require careful alignment and viewing to effect closure and opening. Thus, in accordance with the invention, as shown in the exploded view of FIG. 9, a recess 78 is defined in the side edge of the door 14 and a corresponding recess 80 is defined in the main body 30 of the unit 10. A lip or catch 82 is defined along a portion of the recess 80 in the main body 30 and is adapted to be engaged and grasped by a latch element 84 which is fixedly mounted, for example, with the screws, bolts or the like 86 in the recess 78 of the door 14. The latch element 84 is capable of flexing outwardly away from the door 14 via a living hinge type flexible segment 88. Thus the latching portion 90 of the latch element 84 is deflected by the lip or catch 82 provided on the main body 30 and resiliently snaps back and engages, through the memory of the material, that catch 82 to positively retain the door 14 in its closed disposition. The latching portion 90 can be easily disengaged by reaching into the recess 80 in the main body of the unit, grasping the latch portion 90 and deflecting it outwardly about its living hinge 88 to allow the door 14 to be opened past the catch 82. For aesthetic purposes, a cover 92 is preferably provided to conceal the majority of the latch element as shown.

Because the latch has no moving parts, that is no elements which must be twisted, rotated, or the like, there are no parts which may break or become jammed. Thus, the latch is particularly advantageous for the refrigerator mode of the container of the invention, as it is easily opened and closed particularly without looking. Indeed, any positive latching that requires pivoting or rotation generally requires that the user look closely to ensure the various parts are aligned prior to latching or unlatching. The latch of the invention can be advantageously gripped without looking to disengage the door and can be reengaged by simply pushing the door. Thus the latch assembly of the invention ensures that the door will properly close to maintain the contents cool or warm, as desired.

While the invention has been described in connection with what is presently considered to be the most practical and preferred embodiment, it is to be understood that the invention is not to be limited to the disclosed embodiment, but on the contrary is intended to cover various modifications and equivalent arrangements included within the spirit and scope of the appended claims.

For example, if desired, only the handle on the end of the unit opposite to the end having the thermoelectric heating/cooling system could be recessed and only that end of the container could be formed with a rim, the other handle being simply pivotally mounted to the exterior of the top or electronic end of the unit. The rim at the top or upper end may likewise be omitted. Furthermore, the door may be hingedly attached to the rim on the base end of the unit so that the door pivots open as an oven door. Any suitable latch and or spring loaded closure could be provided for such a door. However, where the top end rim is omitted, the latch of the invention could advantageously be provided at the top edge of the door.

What is claimed is:

1. A container comprising:

a main body have a base wall and four side walls extending from said base wall so as to define a product receiving compartment, each of said side walls having an outer surface and an inner surface with respect to said compartment;

means defining a door pivotally mounted along one edge thereof to one of said side walls, said door having an outer surface and an inner surface with respect to said compartment, said door having a length dimension and a width dimension, at least one of said dimensions being less than a respective dimension of said main body;

thermoelectric means mounted to one of said side walls, said base wall, and said door for selectively heating or cooling the contents of said product receiving compartment;

first and second handles at least one of pivotally and slidably mounted to two opposed side walls of said main body; and latching means for releasably coupling another edge of said door to another side wall of said main body, said latching means comprising a mounting portion and a latch portion, said mounting portion being secured to said door, said latch portion being flexibly and resiliently interconnected to said mounting portion so that said latch portion is deflectable relative to said mounting portion, said main body having a catch element defined thereon, said latch portion selectively engaging said catch element to thereby couple said door to said main body.

2. A container as in claim 1, further comprising air circulating means for circulating air within said compartment.

3. A container comprising:

a main body have a base wall and four side walls extending from said base wall so as to define a product receiving compartment, each of said side walls having an outer surface and an inner surface with respect to said compartment;

means defining a door pivotally mounted along one edge thereof to one of said side walls, said door having an outer surface and an inner surface with respect to said compartment, said door having a length dimension and a width dimension, at least one of said dimensions being less than a respective dimension of said main body; and thermoelectric means mounted to one of said side walls, said base wall, and said door for selectively heating or cooling the contents of said product receiving compartment;

air circulating means for circulating air within said compartment, said air circulating means comprising a fan element, a fan cover having first and second air flow openings and means defining an air flow duct which is operatively coupled to one of said air flow openings of said fan cover at least when said door closes said compartment.

4. A container as in claim 3, wherein said air flow duct comprises a channel defined along a portion of an inner surface of the door and a channel cover mounted thereto so as to define an elongated duct.

5. A container as in claim 4, further comprising at least one air outlet defined through said channel cover at a point along the length thereof.

6. A container as in claim 5, wherein at least two air outlets are defined at spaced locations along the length of the duct, one of said air flow outlets has at least one of more apertures and larger apertures than another of said air flow outlets.

7. A container as in claim 1, further comprising at least one shelf element mounted within said compartment.

8. A container as in claim 3, further comprising first and second recessed handles pivotally mounted to two opposed side walls of said main body.

9. A container as in claim 3, further comprising first and second recessed handles slidably mounted to two opposed side walls of said main body, said handles being slidable in a plane of the side wall to which it is mounted.

10. A container as in claim 1, wherein each of said two opposed side walls has a handle receiving recess in which said handles are mounted, each said handle being substantially U-shaped having a transverse gripping element and first and second leg elements depending therefrom, each said leg element having an channel defined along at least a portion of the length thereof and a distal end wall, and further comprising first and second pin elements projecting into a respective channel so that the handle can slide in the plane of the side wall to which it is mounted and, when said pin elements engage said distal end walls, said main body can be lifted.

11. A container as in claim 10, wherein when said pin elements engage said distal end walls, said handle can be pivoted about said pin elements.

12. A container as in claim 10, wherein said length dimension of said door is less than a length of said main body and said door is mounted to said main body so as to be spaced from each longitudinal end of said main body, and wherein the side walls at the longitudinal ends of said main body terminate adjacent the outer surface of said door so as to define a rim at each longitudinal end of said main body, a said handle being exposed in each said rim and being slidable outwardly therefrom in the plane thereof.

13. A container comprising:

a main body having a base wall and four side walls extending from said base wall so as to define a product receiving compartment;

means defining a door pivotally mounted along one edge thereof to one of said side walls;

thermoelectric means mounted to one of said side walls, said base wall, and said door for selectively heating or cooling the contents of said product receiving compartment; and latching means for releasably coupling another edge of said door to another side wall of said main body, said latching means comprising a mounting portion and a latch portion, said mounting portion being secured to said door, said latch portion being flexibly and resiliently interconnected to said mounting portion so that said latch portion is deflectable relative to said mounting portion, said main body having a catch element defined thereon, said latch portion selectively engaging said catch element to thereby couple said door to said main body, said door having a length dimension and a width dimension, at least one of said dimensions being less than a respective dimension of said main body.

14. A container as in claim 13, wherein said door has a latch recess defined in said another edge, said mounting portion being disposed in said latch recess, and said main body has a catch recess defined in said another side wall, said catch element being defined in said catch recess.

15. A container as in claim 14, further comprising a cover element coupled to said door so as to cover said latch recess and said mounting portion disposed therein.

16. A container comprising:

a main body having a base wall and four side walls extending from said base wall so as to define a product receiving compartment, each of said side walls having an outer surface and an inner surface with respect to said compartment;

means defining a door pivotally mounted along one edge thereof to one of said side walls, said door having a length dimension and a width dimension;

means mounted to one of said side walls, said base wall and said door for selectively heating or cooling the contents of said product receiving compartment; and air circulating means for circulating air within said compartment, said air circulating means comprising a fan element, a fan cover having first and second air flow openings, and means defining an air flow duct which is operatively coupled to one of said air flow openings of said fan cover at least when said door closes said compartment.

17. A container as in claim 16, wherein said means defining an air flow duct extends along at least a portion of one of the dimensions of the door.

18. A container as in claim 17, wherein one of said air flow openings is an air inlet and the other of said air flow openings is an air outlet, and said air flow duct is operatively coupled to said air outlet when said door is closed.

19. A container as in claim 16, wherein at least one of said dimensions of said door is less than a respective dimensions of said main body.

20. A container as in claim 17, wherein said air flow duct comprises a channel defined along a portion of an inner surface of the door and a channel cover mounted thereto so as to define an elongated duct.

21. A container as in claim 20, further comprising at least one air passage defined through said channel cover at a point along the length thereof.

22. A container as in claim 21, wherein at least two air passages are defined at spaced locations along the length of the duct, one of said air passages being defined by at least one of more apertures and larger apertures than another of said air passages.

23. A container comprising:

a main body having a base wall and four side walls extending from said base wall so as to define a product receiving compartment, each of said side walls having an outer surface and an inner surface with respect to said compartment;

means defining a door pivotally mounted along one edge thereof to one of said side walls, said door having an outer surface and an inner surface with respect to said compartment, said door having a length dimension and a width dimension, said length dimension being less than a length of said main body, said door being mounted to said main body so as to be spaced from each longitudinal end of said main body, the side walls at the longitudinal ends of said main body terminating adjacent the outer surface of said door so as to define a rim at each longitudinal end of said main body; and first and second recessed handles mounted to the side walls at the longitudinal ends of said main body, each of said side walls having a handle receiving recess in which said handles are mounted, each said handle being substantially U-shaped having a transverse gripping element and first and second leg elements depending therefrom, each said leg element having an channel defined along at least a portion of the length thereof and a distal end wall, and further comprising first and second pin elements projecting into a respective channel so that the handle can slide in the plane of the side wall to which it is mounted and, when said pin elements engage said distal end walls, said main body can be lifted, a said handle being exposed in each said rim and being slidable outwardly therefrom in the plane thereof.

24. A container as in claim 22, wherein when said pin elements engage said distal end walls, said handle can be pivoted about said pin elements.

25. A container as in claim 22, further comprising latching means for releasably coupling another edge of said door to another side wall of said main body, said latching means comprising a mounting portion and a latch portion, said latch portion being flexibly and resiliently interconnected to said mounting portion so that said latch portion is deflectable relative to said mounting portion.

26. A container as in claim 22, further comprising air circulating means for circulating air within said compartment, said air circulating means comprising a fan element, a fan cover having first and second air flow openings and means defining an air flow duct which is operatively coupled to one of said air flow openings of said fan cover at least when said door closes said compartment.

27. A container as in claim 23, further comprising means mounted to one of said side walls for selectively heating or cooling the contents of said product receiving compartment.

28. A container as in claim 26, wherein said means defining an air flow duct extends along at least a portion of one of the dimensions of the door, said air flow duct comprising a channel defined along a portion of an inner surface of the door and a channel cover mounted thereof so as to define an elongated duct, at least one air outlet being defined through said channel cover at a point along the length thereof.

29. A container as in claim 3, further comprising latching means for releasably coupling another edge of said door to another side wall of said main body.

30. A container as in claim 29, wherein said latching means comprises a mounting portion and a latch portion, said latch portion being flexibly and resiliently inner-connected to said mounting portion so that said latch portion is deflectable relative to said mounting portion.

* * * * *